US012037561B2

(12) United States Patent
Tsuda et al.

(10) Patent No.: US 12,037,561 B2
(45) Date of Patent: Jul. 16, 2024

(54) GREASE COMPOSITION, AND ROLLING BEARING

(71) Applicants: JTEKT CORPORATION, Kariya (JP); ENEOS CORPORATION, Tokyo (JP)

(72) Inventors: Takeshi Tsuda, Kashiba (JP); Yurie Hagino, Kashihara (JP); Kazumi Sakai, Tokyo (JP); Yusuke Ayame, Tokyo (JP); Go Tatsumi, Tokyo (JP); Kiyomi Sakamoto, Tokyo (JP)

(73) Assignees: JTEKT CORPORATION, Kariya (JP); ENEOS CORPORATION, Tokyo (JP)

( * ) Notice: Subject to any disclaimer, the term of this patent is extended or adjusted under 35 U.S.C. 154(b) by 0 days.

(21) Appl. No.: 18/020,743

(22) PCT Filed: Aug. 10, 2021

(86) PCT No.: PCT/JP2021/029534
§ 371 (c)(1),
(2) Date: Feb. 10, 2023

(87) PCT Pub. No.: WO2022/034883
PCT Pub. Date: Feb. 17, 2022

(65) Prior Publication Data

US 2023/0323240 A1 Oct. 12, 2023

(30) Foreign Application Priority Data

Aug. 12, 2020 (JP) ..... 2020-136449

(51) Int. Cl.
*C10M 169/00* (2006.01)
*C10M 105/18* (2006.01)
(Continued)

(52) U.S. Cl.
CPC ..... *C10M 169/00* (2013.01); *C10M 105/18* (2013.01); *C10M 115/08* (2013.01);
(Continued)

(58) Field of Classification Search
CPC ..... C10N 2040/02; C10N 2030/06; C10N 2030/43; C10N 2030/02; C10N 2050/10;
(Continued)

(56) References Cited

U.S. PATENT DOCUMENTS 5,301,923 A 4/1994 Asao et al.
5,966,949 A 10/1999 Futagami et al.
(Continued)

FOREIGN PATENT DOCUMENTS

CN 1170089 A 1/1998
CN 101432404 A 5/2009
(Continued)

OTHER PUBLICATIONS

Nov. 16, 2021 International Search Report issued in International Patent Application No. PCT/JP2021/029534.
(Continued)

*Primary Examiner* — Vishal V Vasisth
(74) *Attorney, Agent, or Firm* — Oliff PLC

(57) ABSTRACT

A grease composition including: a base oil; a thickener; a zinc sulfonate; a polysulfide; an overbased calcium sulfonate; and triphenyl phosphite, in which a proportion of the zinc sulfonate with respect to a total mass of the base oil and the thickener is 0.030 mass % to 0.045 mass % in terms of a zinc content, a proportion of the polysulfide with respect to the total mass of the base oil and the thickener is 0.16 mass % to 0.24 mass % in terms of a sulfur content, a proportion of the overbased calcium sulfonate with respect to the total mass of the base oil and the thickener is 0.010 mass % to 0.015 mass % in terms of a calcium content, and a proportion of the triphenyl phosphite with respect to the total mass of the base oil and the thickener is 0.24 mass % to 0.36 mass %.

5 Claims, 3 Drawing Sheets

(51) Int. Cl.

| | |
|---|---|
| ***C10M 115/08*** | (2006.01) |
| ***C10M 135/10*** | (2006.01) |
| ***C10M 135/20*** | (2006.01) |
| ***C10M 137/02*** | (2006.01) |
| ***C10M 141/10*** | (2006.01) |
| *C10N 30/00* | (2006.01) |
| *C10N 40/02* | (2006.01) |
| *C10N 50/10* | (2006.01) |

(52) U.S. Cl.
CPC ..... *C10M 135/10* (2013.01); *C10M 135/20* (2013.01); *C10M 137/02* (2013.01); *C10M 141/10* (2013.01); *C10M 2207/0406* (2013.01); *C10M 2215/1026* (2013.01); *C10M 2219/044* (2013.01); *C10M 2219/046* (2013.01); *C10M 2219/08* (2013.01); *C10M 2223/049* (2013.01); *C10N 2030/43* (2020.05); *C10N 2040/02* (2013.01); *C10N 2050/10* (2013.01)

(58) Field of Classification Search
CPC . C10N 2010/04; C10M 35/10; C10M 137/02; C10M 141/10; C10M 169/045; C10M 105/18; C10M 135/20; C10M 169/00; C10M 115/08; C10M 2219/022; C10M 2215/1026; C10M 2219/044; C10M 2219/046; C10M 2223/049; C10M 2207/0406; C10M 2219/08
See application file for complete search history.

(56) References Cited

U.S. PATENT DOCUMENTS

| | | | | |
|---|---|---|---|---|
| 6,642,187 | B1 | 11/2003 | Schwind et al. | |
| 2002/0013232 | A1* | 1/2002 | Kinoshita | C10M 119/24 508/363 |
| 2002/0076125 | A1 | 6/2002 | Iso et al. | |
| 2007/0179066 | A1* | 8/2007 | Sakamoto | C10M 169/02 508/113 |
| 2009/0016652 | A1 | 1/2009 | Endo et al. | |
| 2013/0345101 | A1 | 12/2013 | Imai et al. | |
| 2014/0303055 | A1 | 10/2014 | Endo et al. | |
| 2015/0232784 | A1 | 8/2015 | Aida et al. | |
| 2016/0177213 | A1 | 6/2016 | Yoshinari et al. | |
| 2020/0109344 | A1 | 4/2020 | Hagino et al. | |

FOREIGN PATENT DOCUMENTS

| | | | |
|---|---|---|---|
| CN | 104769086 | A | 7/2015 |
| EP | 1 033 400 | A2 | 9/2000 |
| EP | 2 921 549 | A1 | 9/2015 |
| EP | 3 666 860 | A1 | 6/2020 |
| JP | H05-263091 | A | 10/1993 |
| JP | H08-060174 | A | 3/1996 |
| JP | 2002-195277 | A | 7/2002 |
| JP | 2003-321694 | A | 11/2003 |
| JP | 2012-180439 | A | 9/2012 |
| JP | 2020-059776 | A | 4/2020 |
| WO | 2012/124815 | A1 | 9/2012 |
| WO | 2015/016376 | A1 | 2/2015 |
| WO | 2020/095359 | A1 | 5/2020 |

OTHER PUBLICATIONS

Nov. 16, 2021 Written Opinion issued in International Patent Application No. PCT/JP2021/029534.
Apr. 22, 2023 Office Action issued in German Patent Application No. 11 2021 004 265.3.
Mar. 22, 2024 Office Action issued in Chinese Patent Application No. 202180056136.2.

* cited by examiner

GREASE COMPOSITION, AND ROLLING BEARING

This application is a 371 of PCT/JP2021/029534, filed Aug. 10, 2021.

TECHNICAL FIELD

The present invention relates to a grease composition and a rolling bearing in which the grease composition is enclosed.

BACKGROUND ART

Bearings used in automotive electrical components such as an alternator, an electromagnetic clutch for car air conditioners, an intermediate pulley, and an electric fan motor, and auxiliary equipment for automotive engines are used in severe environments such as a high temperature, a high speed, a high load, and a high vibration.

In rolling bearings used in such a severe environment, premature flaking may occur in a locking collar and a rolling element due to structural changes in steel during use. The premature flaking due to structural changes in steel is characterized by the presence of white structures, unlike flaking originating from the inside, and is called white layer flaking.

In recent years, use conditions of rolling bearings have become more severe, and white layer flaking is more likely to occur in rolling bearings.

On the other hand, greases have been proposed for the purpose of solving the problem in white layer flaking.

For example, Patent Literature 1 proposes that a grease containing a conductive substance such as carbon black in a proportion of 0.1 mass % to 10 mass % is used to prevent flaking due to a white structural change caused by hydrogen.

CITATION LIST

Patent Literature

Patent Literature 1: JP2002-195277A

SUMMARY OF INVENTION

Technical Problem

It is considered that the white layer flaking is mainly caused by an increase in internal stress due to slide, a high surface pressure, or an impact load, and further, as the internal stress increases, a new surface is generated on a friction surface between inner and outer rings and the rolling element, and a chemical reaction between this new surface and the moisture in the air or the grease generates hydrogen, which accelerates the white layer flaking by penetrating the bearing steel.

In recent years, the number of fuel cell vehicles (FCV) has been increasing. For example, hydrogen circulation pumps used in the fuel cell vehicles are used in a low-pressure hydrogen atmosphere. Therefore, in bearings used in the hydrogen circulation pumps, hydrogen tends to penetrate the bearing steel, which easily accelerates the white layer flaking. In addition, in the bearings used in the hydrogen circulation pumps, since there is no oxygen in the environment, oxide films or tribofilms are less likely to be formed on the friction surface between the inner and outer rings and the rolling element, and in this respect also, the hearings used in the hydrogen circulation pumps are likely to occur white layer flaking.

Therefore, it is an important issue to prevent the occurrence of white layer flaking.

On the other hand, with the grease containing a predetermined amount of carbon black as proposed in Patent Literature 1, it is difficult to sufficiently prevent the white layer flaking.

Therefore, there is a continuing need for a grease that is more suitable for avoiding the white layer flaking described above.

Solution to Problem

The present inventors have made intensive studies to meet the above requirements, and have found that a grease composition including predetermined amount of a zinc sulfonate, a polysulfide, an overbased calcium sulfonate, and triphenyl phosphite as additives is suitable for preventing the occurrence of white layer flaking in a rolling bearing. Thus, the present invention has been completed.

A grease composition according to the present invention includes a base oil, a thickener, a zinc sulfonate, a polysulfide, an overbased calcium sulfonate, and triphenyl phosphite.

Here, a proportion of the zinc sulfonate with respect to a total mass of the base oil and the thickener is 0.030 mass % to 0.045 mass % in terms of a zinc content, a proportion of the polysulfide with respect to the total mass of the base oil and the thickener is 0.16 mass % to 0.24 mass % in terms of a sulfur content, a proportion of the overbased calcium sulfonate with respect to the total mass of the base oil and the thickener is 0.010 mass % to 0.015 mass % in terms of a calcium content, and a proportion of the triphenyl phosphite with respect to the total mass of the base oil and the thickener is 0.24 mass % to 0.36 mass %.

The grease composition according to the present invention includes the above composition including specific four types of additives, and can thus prevent the occurrence of white layer flaking in a rolling bearing when used in the rolling bearing. It is considered that this is because in a rolling bearing using a grease composition including four types of additives with different mechanisms of action, a tribofilm is early formed on a friction surface of inner and outer rings or a rolling element when the rolling bearing is used in an air atmosphere or a hydrogen atmosphere.

It is preferable that in the grease composition, the base oil is an alkyl diphenyl ether, the thickener is an alicyclic diurea, and a proportion of the thickener with respect to the total mass of the base oil and the thickener is 10 mass % to 14 mass %.

In addition, a rolling bearing according to the present invention is a rolling bearing in which the grease composition according to the present invention is enclosed.

Advantageous Effects of Invention

The grease composition according to the present invention can prevent the occurrence of white layer flaking in a rolling bearing when used in the rolling bearing.

In addition, the rolling bearing according to the present invention is a rolling bearing less likely to occur white layer flaking since the grease composition is enclosed therein.

DESCRIPTION OF EMBODIMENTS

Hereinafter, an embodiment of the present invention will be described with reference to the drawings.

A rolling bearing according to an embodiment of the present invention is a ball bearing in which a grease including a grease composition according to an embodiment of the present invention is enclosed.

Figure 1:
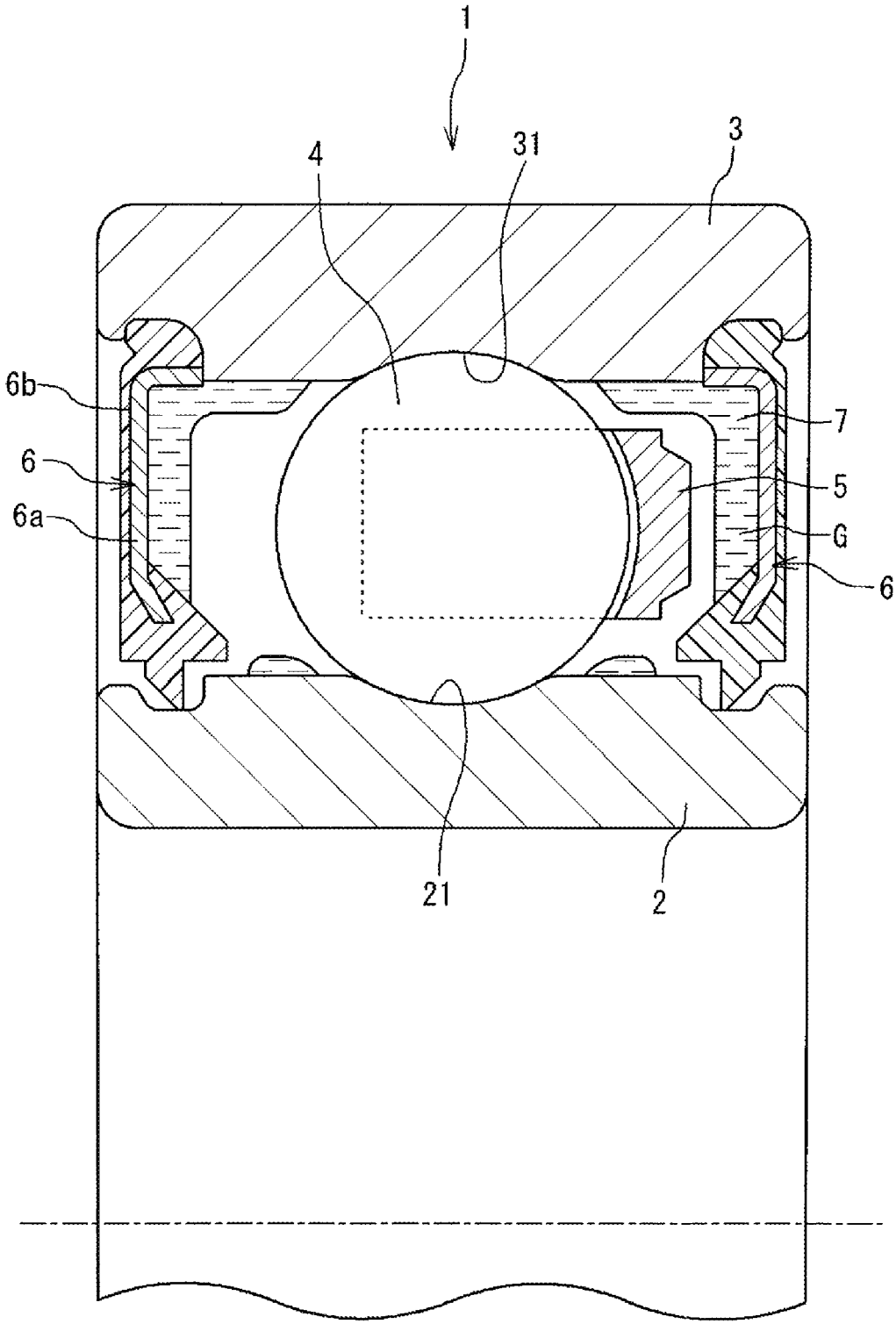
FIG. 1 is a cross-sectional view illustrating a ball bearing according to one embodiment of the present invention.

FIG. 1 is a cross-sectional view illustrating a ball bearing according to one embodiment of the present invention.

A ball bearing 1 includes an inner ring 2, an outer ring 3 provided at a radially outer side of the inner ring 2, balls 4 as a plurality of rolling elements provided between the inner ring 2 and the outer ring 3, and an annular cage 5 for holding these balls 4. In addition, the ball bearing 1 includes seals 6 on one side and the other side in an axial direction.

Further, an annular region 7 between the inner ring 2 and the outer ring 3 encloses a grease G including the grease composition according to the embodiment of the present invention.

The inner ring 2 has, on an outer circumference thereof, an inner raceway surface 21 on which the balls 4 roll.

The outer ring 3 has, on an inner circumference thereof, an outer raceway surface 31 on which the balls 4 roll.

A plurality of balls 4 are interposed between the inner raceway surface 21 and the outer raceway surface 31 and roll on the inner raceway surface 21 and the outer raceway surface 31.

The grease G enclosed in the region 7 is interposed at contact points between the balls 4 and the inner raceway surface 21 of the inner ring 2 and at contact points between the balls 4 and the outer raceway surface 31 of the outer ring 3. The grease G is enclosed to occupy 20 vol % to 40 vol % with respect to a volume of a space surrounded by the inner ring 2, the outer ring 3, and the seals 6 excluding the balls 4 and the cage 5.

Each of the seal 6 is an annular member including an annular metal ring 6*a* and an elastic member 6*b* fixed to the metal ring 6*a*. A radially outer portion of the seal 6 is fixed to the outer ring 3, and a lip tip of a radially inner portion of the seal 6 is attached to the inner ring 2 so as to be slidable. The seal 6 prevents the enclosed grease G from leaking to the outside.

The ball bearing 1 configured as described above encloses, as the grease G, a grease including the grease composition according to the embodiment of the present invention, which will be described later, Therefore, the ball bearing 1 enclosed the grease G is less likely to occur white layer flaking even when used in a severe environment such as a high temperature, a high speed, a high load, and a high vibration. In addition, the ball bearing 1 is less likely to occur white layer flaking even when used in a hydrogen atmosphere.

Next, a grease composition constituting the grease Ci will be described in detail.

The grease composition constituting the grease Ci is the grease composition according to the embodiment of the present invention, and includes a base oil, a thickener, a zinc sulfonate, a polysulfide, an overbased calcium sulfonate, and triphenyl phosphite.

The grease composition includes a zinc sulfonate, a polysulfide, an overbased calcium sulfonate, and triphenyl phosphite as essential components in addition to a base oil and a thickener. Therefore, when used in a rolling bearing, it is extremely suitable for preventing the occurrence of white layer flaking in the rolling bearing.

In the grease composition, examples of the base oil include an alkyl diphenyl ether, a poly-α-olefin (PAO), an ester oil, a polyalkylene glycol, a fluorine oil, and a silicone oil.

Among them, an alkyl diphenyl ether is preferred from the viewpoint of evaporation resistance at a high temperature and oxidation stability.

As the alkyl diphenyl ether, a well-known alkyl diphenyl ether used as a base oil for a grease for rolling bearings can be used.

As the alkyl diphenyl ether, for example, those represented by the following structural formulas (1) and (2) can be used.

[Chem. 1]

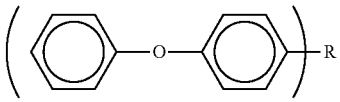

(1)

(In the formula (1), R represents an a group having 10 to 18 carbon atoms. R is bonded to a benzene ring.)

[Chem. 2]

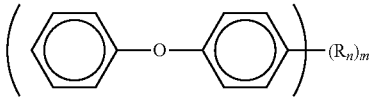

(2)

(In the formula (2), Rn represents an alkyl group having 10 to 18 carbon atoms. m is an integer from 2 to 10. Each Rn is bonded to a benzene ring. Each Rn may be the same as or different from one another.)

A base oil kinematic viscosity at 40° C. is preferably 50 $mm^2/s$ to 150 $mm^2/s$, and more preferably 80 $mm^2/s$ to 120 $mm^2/s$. In this case, it is suitable for ensuring heat resistance and low-temperature fluidity of the grease composition.

The base oil kinematic viscosity is a value in accordance with JIS K 2283:2000.

In the grease composition, examples of the thickener include a urea-based thickener.

Examples of the urea-based thickener include urea compounds such as a diurea, a triurea, a tetraurea, and a polyurea (excluding a diurea, a triurea, and a tetraurea), urea-urethane compounds, urethane compounds such as a diurethane, and a mixture thereof.

The urea-based thickener is preferably a diurea represented by the following structural formula (3).

$$R^1\text{—NHCONH—}R^2\text{—NHCONH—}R^3 \quad (3)$$

(In the formula (3), $R^1$ and $R^3$ each independently represent an amino residue, and $R^2$ represents a diisocyanate residue.)

The diurea is preferably an alicyclic diurea in which the amino residue is an alicyclic amine residue. This is because, in this case, shear stability at a high speed is excellent.

The diurea represented by the above structural formula (3) is a reaction product of an amine compound and a diisocyanate compound.

Examples of the amine compound include an alkylamine, an alkylphenylamine, and cyclohexylamine.

Among them, cyclohexylamine is preferred.

Examples of the diisocyanate compound include an aliphatic diisocyanate, an alicyclic diisocyanate, and an aromatic diisocyanate.

Among them, an aromatic diisocyanate is preferred because of being suitable for forming a grease composition having good heat resistance.

Examples of the aromatic diisocyanate include 4,4'-diphenylmethane diisocyanate, 2,4-tolylene diisocyanate, 2,6-tolylene diisocyanate, a mixture of 2,4-tolylene diisocyanate and 2,6-tolylene diisocyanate, and 3,3'-dimethyldiphenyl-44-diisocyanate. Among them, 4,4'-diphenylmethane diisocyanate is preferred from the viewpoint of easy availability and good heat resistance.

In order to obtain the diurea represented by the above structural formula (3), the amine compound and the diisocyanate compound can be reacted under various conditions. It is preferable to carry out the reaction in the base oil since a diurea compound having highly, uniform dispersibility can be obtained as a thickener.

The reaction between the amine compound and the diisocyanate compound may be carried out by adding a base oil in which the diisocyanate compound is dissolved to a base oil in which the amine compound is dissolved, or may be carried out by adding a base oil in which the amine compound is dissolved to a base oil in which the diisocyanate compound is dissolved.

The temperature and time for the reaction between the amine compound and the diisocyanate compound are not particularly limited, and the same conditions as those usually used in this type of reaction may be used.

The reaction temperature is preferably 60° C. to 170° C. from the viewpoint of solubility and volatility of the amine compound and the diisocyanate compound.

The reaction time is preferably 2.0 hours to 6.0 hours from the viewpoint of completing the reaction between the amine compound and the diisocyanate compound or shortening the production time to efficiently produce the grease.

A content of the thickener is preferably 10 mass % to 14 mass % with respect to a total mass of the base oil and the thickener.

In the case where the content of the thickener is less than 10 mass %, the ability of the grease to retain the base oil is reduced, and a possibility that a large amount of the base oil separates from the grease during rotation of the rolling bearing is increased. On the other hand, in the case where the content of the thickener is more than 14 mass %, the grease composition becomes hard, and when the grease composition is enclosed in a rolling bearing and used, a torque of the rolling bearing may increase.

The grease composition includes, as essential additives, (a) the zinc sulfonate, (b) the polysuffide, (c) the overbased calcium sulfonate, and (d) the triphenyl phosphite.

All of these additives are known additives, and it is important to use these four additives together as essential components in the grease composition. Accordingly, the occurrence of white layer flaking in the rolling bearing can be prevented regardless of under an air atmosphere or under a hydrogen atmosphere.

(a) Zinc Sulfonate

The zinc sulfonate is a compound known in the field of lubricants as a rust inhibitor and the like.

Examples of the zinc sulfonate include a zinc sulfonate represented by the following general formula (4).

$$[R^4—SO_3]_2Zn \quad (4)$$

(In the formula (4), $R^4$ represents an alkyl group, an alkenyl group, an alkylnaphthyl group, a dialkylnaphthyl group, an alkylphenol group, or a petroleum high-boiling fraction residue.)

In the above $R^4$, each of alkyl and alkenyl may be linear or branched. In the above $R^4$, the number of carbon atoms in the alkyl and the number of carbon atoms in the alkenyl are each preferably 2 to 22.

The above $R^4$ is more preferably an alkylphenyl group in which the alkyl part has 10 to 18 carbon atoms.

A commercially available product can also be used as the zinc sulfonate. Specific examples of the commercially available product include NA-SUL ZS-HT manufactured by KING CO., LID.

A proportion of the zinc sulfonate with respect to the total mass of the base oil and the thickener is 0.030 mass % to 0.045 mass % in terms of a zinc content.

In the case where the proportion of the zinc sulfonate is within the range of 0.030 mass % to 0.045 mass % in terms of a zinc content, the grease composition is suitable for preventing the occurrence of white layer flaking when used in a rolling bearing.

On the other hand, in the case where the proportion of the zinc sulfonate is less than 0.030 mass % in terms of a zinc content, the occurrence of white layer flaking cannot be prevented. In addition, in the case where the proportion of the zinc sulfonate is more than 0.045 mass % in terms of a zinc content, the grease composition is softened and, when used in a rolling bearing, may leak from the rolling bearing.

When the above NA-SUL ZS-HT is used as the zinc sulfonate, the amount to be blended is preferably 0.8 mass % to 1.2 mass % with respect to the total mass of the base oil and the thickener.

(b) Polysulfide

The polysulfide is a compound known in the field of lubricants as a friction modifier and the like.

Examples of the polysulfide include a compound represented by the following structural formula (5).

$$R^5—(S)x—R^6 \quad (5)$$

(In the formula (5), $R^5$ and $R^6$ each represent a linear or branched alkyl group having 3 to 20 carbon atoms, an aryl group having 6 to 20 carbon atoms, an alkylaryl group or an arylalkyl group. x is an integer of 1 to 10. $R^5$ and $R^6$ may be the same as or different from each other.)

The above x is preferably an integer of 2 to 6. The above (S)x may be linear, or may be partially or wholly cyclic.

A commercially available product can also be used as the polysulfide. Specific examples of the commercially available product include DAILUBE GS-440L manufactured by DIC Corporation.

A proportion of the polysulfide with respect to the total mass of the base oil and the thickener is 0.16 mass % to 0.24 mass % in terms of a sulfur content.

In the case where the proportion of the polysulfide is within the range of 0.16 mass % to 0.24 mass % in terms of a sulfur content, the grease composition is suitable for preventing the occurrence of white layer flaking when used in a rolling bearing.

On the other hand, in the case where the proportion of the polysulfide is less than 0.16 mass % in terms of a sulfur content, the occurrence of white layer flaking cannot be prevented. In addition, in the case where the proportion of the zinc polysulfide is more than 0.24 mass % in terms of a sulfur content, the grease composition is softened and, when used in a rolling bearing, may leak from the rolling bearing.

In the case where the above DAILUBE GS-440L is used as the polysulfide, the amount to be blended is preferably 0.4 mass % to 0.6 mass % with respect to the total mass of the base oil and the thickener.

(c) Overbased Calcium Sulfonate

The overbased calcium sulfonate is a compound known in the field of lubricants as a metal detergent and the like.

Examples of the overbased calcium sulfonate include a compound containing calcium sulfonate and calcium carbonate, which is represented by the following general formula (6).

$$[R^7—SO_3]_2Ca\cdot nCaCO_3 \quad (6)$$

(In the formula (6), $R^7$ represents an alkyl group, an alkenyl group, an alkylnaphthyl group, a dialkylnaphthyl group, an alkylphenyl group, or a petroleum high-boiling fraction residue. n is an integer of 6 to 50.)

In the above $R^7$, each of alkyl and alkenyl may be linear or branched. In the above $R^7$, the number of carbon atoms in the alkyl and the number of carbon atoms in the alkenyl are each preferably 2 to 22.

The above $R^7$ is more preferably an alkylphenyl group in which the alkyl part has 10 to 18 carbon atoms.

The overbased calcium sulfonate is preferably one having a base number of 50 mgKOH/g to 500 mgKOH/g in accordance with JIS K 2501:2003.

A commercially available product can also be used as the overbased calcium sulfonate. Specific examples of the commercially available product include Hybase C-311 manufactured by LANXESS.

A proportion of the overbased calcium sulfonate with respect to the total mass of the base oil and the thickener is 0.010 mass % to 0.015 mass % in terms of a calcium content.

In the case where the proportion of the overbased calcium sulfonate is within the range of 0.010 mass % to 0.015 mass % in terms of a calcium content, the grease composition is suitable for preventing the occurrence of white layer flaking when used in a rolling bearing.

On the other hand, in the case where the proportion of the overbased calcium sulfonate is less than 0.010 mass % in terms of a calcium content, the occurrence of white layer flaking cannot be prevented. In addition, in the case where the proportion of the overbased calcium sulfonate is more than 0.015 mass % in terms of a calcium content, the grease composition is softened and, when used in a rolling bearing, may leak from the rolling bearing.

In the case where the above Hybase C-311 is used as the overbased calcium sulfonate, the amount to be blended is preferably 0.08 mass % to 0.12 mass % with respect to the total mass of the base oil and the thickener.

(d) Triphenyl Phosphite

Triphenyl phosphite is a compound known in the field of lubricants as an extreme pressure agent, antioxidant, and the like, and is represented by the following structural formula (7).

[Chem. 3]

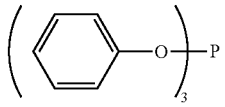

(7)

A commercially available product can also be used as the triphenyl phosphite. Specific examples of the commercially available product include JP-360 manufactured by JOHOKU CHEMICAL CO., LTD.

A proportion of the triphenyl phosphite with respect to the total mass of the base oil and the thickener is 0.24 mass % to 0.36 mass %.

In the case where the proportion of the triphenyl phosphite is within the range of 0.24 mass % to 0.36 mass %, the grease composition is suitable for preventing the occurrence of white layer flaking when used in a rolling bearing.

On the other hand, in the case where the proportion of the triphenyl phosphite is less than 0.24 mass %, the occurrence of white layer flaking cannot be prevented. In addition, in the case where the proportion of the triphenyl phosphite is more than 0.36 mass %, the grease composition is softened and, when used in a rolling bearing, may leak from the rolling bearing.

The grease composition may include additives other than the four types of additives described above as long as the effects of the present invention are not impaired. Examples of other additives include antioxidants, rust inhibitors, extreme pressure agents, antiwear agents, dyes, hue stabilizers, tackiness agents, structural stabilizers, metal deactivators, and viscosity index improvers.

In the case where these other additives are included, the total content of these other additives in the grease composition is preferably 10 mass % or less with respect to the total mass of the base oil and the thickener.

The grease composition according to the present invention can be used where grease lubrication is required, and is preferably used as a grease for rolling bearings. In particular, the grease composition according to the present invention is suitable as a grease for rolling bearings that are required to be resistant to white layer flaking. The grease composition according to the present invention is also suitable as a grease composition for rolling bearings used under a hydrogen atmosphere.

Therefore, a grease including the above grease composition is preferably used as a grease to be enclosed in rolling bearings used in severe environments, for example, bearings in automotive electrical components such as an alternator, an electromagnetic clutch for car air conditioners, an intermediate pulley, and an electric fan motor, bearings in auxiliary equipment for automotive engines, and bearings in a CVT (steel belt type continuously variable transmission). Further, the grease including the grease composition can also be suitably used as a grease to be enclosed in rolling hearings of devices to be exposed to a hydrogen atmosphere, such as hydrogen circulation pumps for fuel cell vehicles (FCV).

For example, the grease composition can be produced by first preparing a mixture of a base oil and a thickener (a base grease), then adding (a) a zinc sulfonate, (b) a polysulfide, (c) an overbased calcium sulfonate, and (d) triphenyl phosphite, and other additives different from the above additives (a) to (d) to be included as necessary to the obtained base grease, and stirring and mixing the above components using a rotation/revolution mixer or the like.

The present invention is not limited to the embodiment described above, and can also be implemented in other embodiments.

The rolling bearing according to the embodiment of the present invention is not limited to a ball bearing in which the grease composition according to the embodiment of the present invention is enclosed. The rolling bearing may be a needle bearing, a roller bearing, or other rolling bearings using parts other than balls as rolling elements, as long as the grease composition according to the embodiment of the present invention is enclosed therein.

EXAMPLES

Next, the present invention will be described in more detail based on Examples, but the present invention is not limited only to these Examples.

Here, a plurality of grease compositions was prepared and properties of each grease composition were evaluated. The composition and evaluation results of each grease composition were shown in Table 1.

The following raw materials were used in Examples/Comparative Examples.

- Diisocyanate compound: 4,4'-diphenylmethane diisocyanate (MDI)
- Amine compound: cyclohexylamine
- Base oil: alkyl diphenyl ether (kinematic viscosity at 40° C. is 100 $mm^2/s$)
- Zinc sulfonate: NA-SUL ZS-HT manufactured by KING CO., LTD. (contains 3.8 mass % of zinc)
- Polysulfide: DAILUBE GS-440L manufactured by DIC Corporation (contains 40 mass % of sulfur)
- Overbased calcium sulfonate: Hybase C-311 manufactured by LANXESS (contains 12 mass % of calcium)
- Triphenyl phosphite: JP-360 manufactured by JOHOKU CHEMICAL CO., LTD. (contains 100 mass % of triphenyl phosphite)

Example 1

(1) An amine compound (cyclohexylamine) as a raw material of a thickener was mixed with and dissolved in half the amount of an alkyl diphenyl ether prepared to have a base oil content shown in Table 1 so as to have a thickener content shown in Table 1, thereby preparing a solution A.

(2) Separately from the preparation of the solution A, a diisocyanate compound (MDI) as a raw material of a thickener was mixed with half the amount of an alkyl diphenyl ether prepared to have a base oil content shown in Table 1 so as to have a thickener content shown in Table 1, and the mixture was heated to 70° C. and dissolved to prepare a solution B.

The contents of the base oil and the thickener shown in Table 1 are proportions with respect to the total mass of the base oil and the thickener.

(3) While stirring the solution B, the solution A was gradually added thereto. After the addition, the mixture was held at 150° C. for 30 minutes. Thereafter, the mixture was allowed to cool while stirring was continued.

(4) After confirming that the obtained mixture of the base oil and the thickener was 60° C. or lower, "NA-SUL ZS-HT (manufactured by KING CO., LTD)", "DAILUBE GS-440L (manufactured by DIC Corporation)", "Hybase C-311 (manufactured by LANXESS)", and "JP-360 (manufactured by JOHOKU CHEMICAL CO., LTD.)" were added thereto to have the contents shown in Table 1, and the mixture was allowed to cool to room temperature while continuing stirring.

The contents of the additives shown in Table 1 proportions with respect to the total mass of the base oil and the thickener.

(5) Finally, homogenization treatment was performed by using a three-roll mill to obtain a grease composition.

Comparative Example 1

A grease composition was obtained in the same manner as in Example 1 except that "NA-SUL ZS-HT (manufactured by KING CO., LID)" and "DAILUBE GS-440L (manufactured by DIC Corporation)" were not added in step (4) of Example 1.

Comparative Example 2

A grease composition was obtained in the same manner as in Example 1 except that "JP-360 (manufactured by JOHOKU CHEMICAL CO., LTD.)" was not added in step (4) of Example 1.

Comparative Example 3

A grease composition was obtained in the same manner as in Example 1 except that "Hybase C-311 (manufactured by LANXESS)" was not added in step (4) of Example 1.

Comparative Example 4

A grease composition was obtained in the same manner as in Example 1 except that "DAILUBE GS-440L (manufactured by DIC Corporation)" was not added in step (4) of Example 1.

Evaluation for Grease Composition

The grease compositions prepared in Example 1 and Comparative Examples 1 to 4 were evaluated. The results were shown in Table 1.

TABLE 1

| | | | Example | Comparative Example | | | |
|---|---|---|---|---|---|---|---|
| | | Unit | 1 | 1 | 2 | 3 | 4 |
| Thickener | Alicyclic diurea (MDI/cyclohexylamine) | mass % | | | 12 | | |
| Base oil | Alkyldiphenyl ether (kinematic viscosity: 100 $mm^2/s$) | mass % | | | 88 | | |
| Additive | Zinc sulfonate (NA-SUL ZS-HT) | mass % | 1 | — | 1 | 1 | 1 |

TABLE 1-continued

| | | Unit | Example 1 | Comparative Example 1 | 2 | 3 | 4 |
|---|---|---|---|---|---|---|---|
| | Polysulfide (DAILUBE GS-440L) | mass % | 0.5 | — | 0.5 | 0.5 | — |
| | Overbased Ca sulfonate (Hybase C-311) | mass % | 0.1 | 0.1 | 0.1 | — | 0.1 |
| | Triphenyl phosphite (JP-360) | mass % | 0.3 | 0.3 | — | 0.3 | 0.3 |
| Property | Worked penetration (60 W) | — | 363 | 361 | 345 | 342 | 337 |
| Performance | Steel ball wear track area | $mm^2$ | 0.30 | 0.45 | 0.43 | 0.58 | 0.53 |
| | Lifetime | h | >300 | 242 | 164 | 146 | >300 |
| | Presence or absence of white structure | — | Absence | Presence | Presence | Presence | Presence |
| | Presence or absence of flaking occurrence | — | Absence | Presence | Absence | Presence | Presence |

The evaluation method of each evaluation shown in Table 1 is as follows.

[1] Worked Penetration (60 W)

The worked penetration (60 W) was measured by a method in accordance with JIS K 2220:2013.

[2] Steel Ball Wear Track Area

Figure 2:
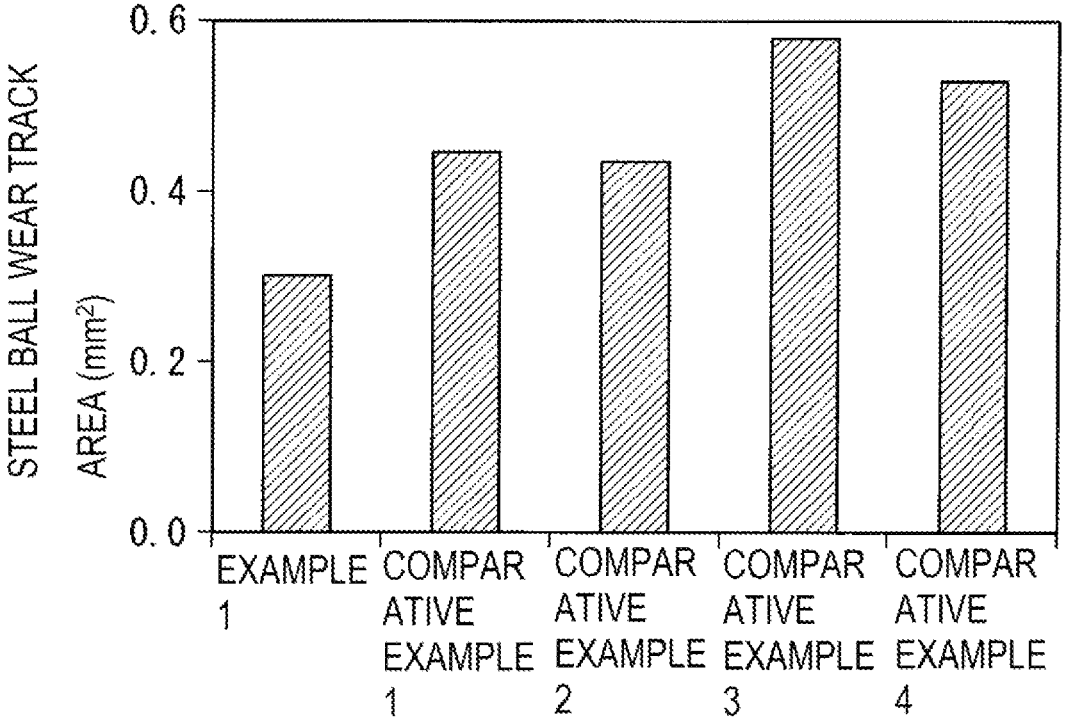
FIG. 2 is a diagram showing evaluation results for steel ball wear track areas evaluated in Examples and Comparative Examples.

Using a friction wear tester (Friction Player FPR2100 manufactured by RHESCA CO., LTD.), the grease compositions prepared in Examples and Comparative Examples were subjected to a ball-on-disk friction wear test to evaluate a wear amount (steel ball wear track area). The results were shown in Table 1 and FIG. 2.

Here, a disk made of SUJ2 was coated with the grease composition, a test load of 30 N was applied thereto, and a steel ball made of SUJ2 was brought into contact therewith.

In this state, the disk was rotated for 10 hours, and thereafter, the steel ball wear track area ($mm^2$) was measured as the wear amount. This test was performed under an air atmosphere. Details of the test conditions are as shown in Table 2.

TABLE 2

| | Conditions |
|---|---|
| Material of test piece | SUJ2 (ball, disk) |
| Test load | 30 N |
| Sliding speed | 0.2 m/s |
| Test temperature | 60° C. |
| Test time | 10 hours |
| Atmosphere | Air atmosphere |
| Shape of test piece | Ball: 4.76 mm in diameter |
| | Disk: 28 mm in diameter, 3.2 mm in thickness |
| Evaluation item | Steel ball wear track area (wear amount) |
| Tester | Friction Player |

[3] Lifetime, Presence or Absence of White Structure. And Presence or Absence of Flaking Using a thrust-type rolling fatigue tester, a rolling fatigue test using the grease compositions prepared in Examples and Comparative Examples was performed under a hydrogen atmosphere (see FIG. 3), and a time required for a vibration value of a vibration meter to reach four times an initial value (described as "lifetime" in Table 1) was measured. The maximum test time was 300 hours, and the test was terminated after 300 hours regardless of whether the vibration value of the vibration meter reached four times the initial value.

Figure 3:
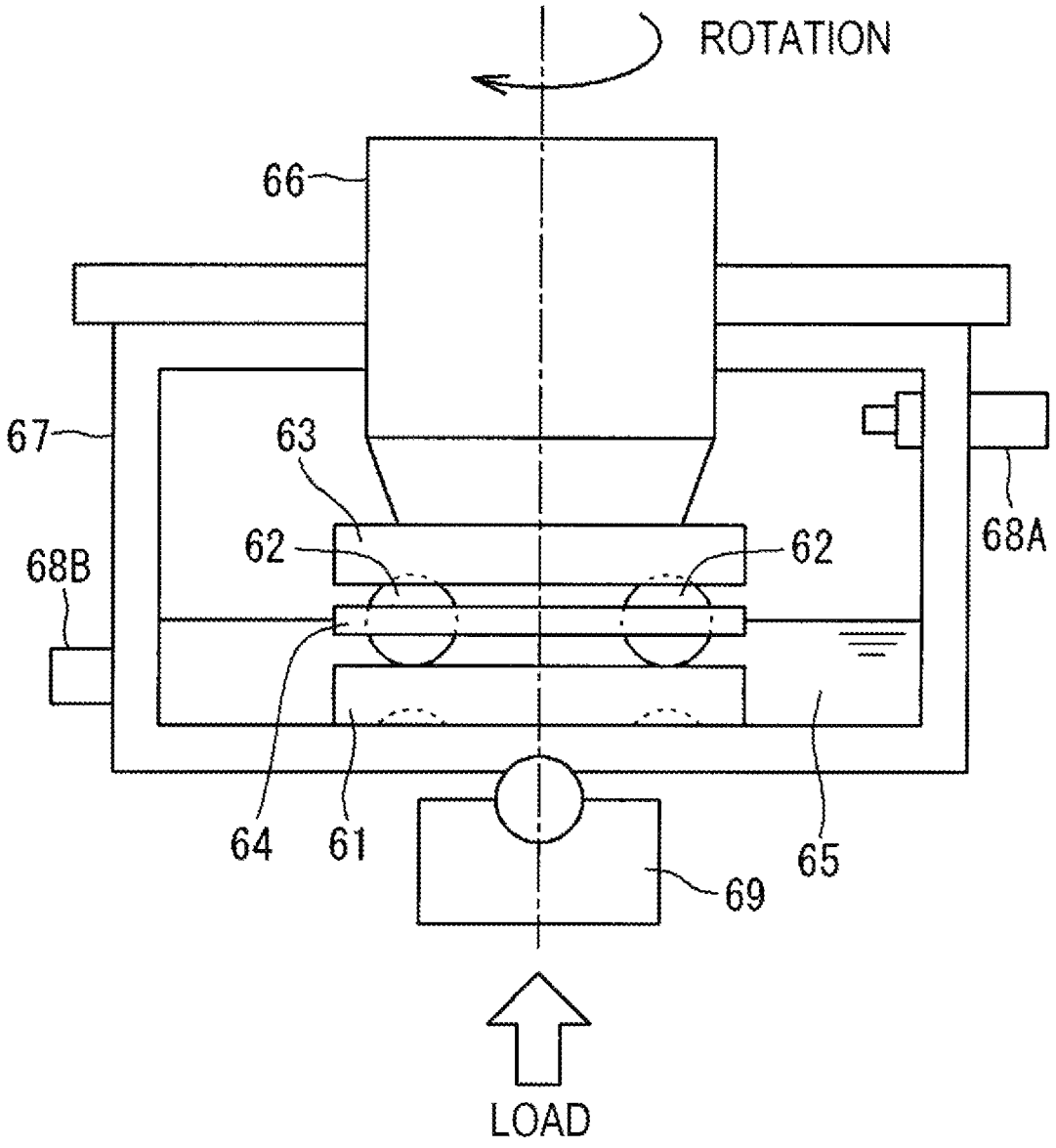
FIG. 3 is a diagram illustrating an outline of a thrust-type rolling fatigue test used in lifetime evaluations for Examples and Comparative Examples.

FIG. 3 is a diagram illustrating an outline of a thrust-type rolling fatigue test according to this evaluation.

Here, a test piece using a thrust ball bearing was prepared and tested.

In this test, a bearing washer (thrust race) 63 having a raceway groove and a plurality of balls 62 was disposed between a rotation shaft 66 and a receiving member 61 in a test chamber 67 having a gas supply port 68A and a gas discharge port 68B. Here, the receiving member 61 was obtained by inverting one thrust race of the thrust ball bearing, and was installed to come into contact with the ball 62 on a back surface of the thrust race. The receiving member 61, the balls 62, and the bearing washer 63 are all made of SUJ2. In this test, three balls 62 are used, and the balls 62 are held by a cage 64 between the receiving member 61 and the bearing washer 63 at equal intervals in a circumferential direction so as to be free to roll.

In this test, a grease composition 65 was injected into the test chamber 67 to be present in at least contact points with the receiving member 61 and the ball 62, hydrogen gas was supplied from the gas supply port 68A, and the test was performed under a hydrogen atmosphere.

The test method is as follows. Details of the test conditions are as shown in Table 3.

A load shaft 69 applied a test load of 2450 N to press an upper surface of the receiving member 61 against the balls 62, and the rotation shaft 66 was rotated to roll the balls 62 on the upper surface of the receiving member 61. Then, a time required for a vibration value of a vibration meter (not shown) to reach four times an initial value was measured. The maximum test time was 300 hours. In this test, the test was terminated when the vibration value of the vibration meter reached four times the initial value.

After the test was completed, the surface of the ball 62 was observed visually and with a microscope.

As shown from the results in Table 1, in the evaluation using the grease composition prepared in Comparative Examples, in the evaluation of Comparative Examples 1 and 3, the vibration value reached four times the initial value within 300 hours, and when the vibration value reached four times the initial value, a white structure was observed on the surface of the ball 62, and the occurrence of flaking was also observed. In addition, in the evaluation of Comparative Example 2, when the vibration value reached four times the initial value, no flaking occurred, but a white structure was observed on the surface of the ball 62. Further, in the evaluation of Comparative Example 4, the vibration value did not reach four times the initial value within 300 hours, but a white structure was observed on the surface of the ball 62 after 300 hours, and the occurrence of flaking was also observed.

On the other hand, in the evaluation using the grease composition prepared in Example 1, the vibration value did not reach four times the initial value within 300 hours, and neither a white structure nor flaking was observed on the surface of ball 62.

TABLE 3

| | Conditions |
|---|---|
| Material of test piece | SUJ2 (ball, disk) |
| Test load | 2450 N |
| Sliding speed | 2.4 m/s |
| Test temperature | 120° C. |
| Test cycle | 1000000 |
| Atmosphere | Hydrogen |
| Shape of test piece | Ball: 9.52 mm in diameter<br>Disk: 52 mm in diameter, 5.1 mm in thickness* |
| Evaluation item | Presence or absence of white layer flaking |
| Tester | Thrust-type rolling fatigue tester |

*The dimension of the disk is an outer diameter of the receiving member 61.

As is clear from the results of Examples and Comparative Examples, when the grease composition according to the embodiment of the present invention is enclosed in a rolling bearing and used, it has excellent wear resistance and is less likely to change to white layer structure and less likely to occur white layer flaking, and is considered to contribute to the extension of the lifetime of the rolling bearing.

In addition, the rolling bearing using the grease composition according to the embodiment of the present invention is considered to prevent the occurrence of white layer flaking even when used in a hydrogen atmosphere.

The present application is based on Japanese Patent Application No. 2020-136449 filed on Aug. 12, 2020, the contents of which are incorporated herein by reference.

REFERENCE SIGNS LIST

1: ball bearing
2: inner ring
3: outer ring
4: bail
5: cage
6: seal
7: region
G: grease

The invention claimed is:

1. A grease composition comprising:
a base oil;
a thickener;
a zinc sulfonate;
a polysulfide;
an overbased calcium sulfonate; and
triphenyl phosphite, wherein
a proportion of the zinc sulfonate with respect to a total mass of the base oil and the thickener is 0.030 mass % to 0.045 mass % in terms of a zinc content,
a proportion of the polysulfide with respect to the total mass of the base oil and the thickener is 0.16 mass % to 0.24 mass % in terms of a sulfur content,
a proportion of the overbased calcium sulfonate with respect to the total mass of the base oil and the thickener is 0.010 mass % to 0.015 mass % in terms of a calcium content, and
a proportion of the triphenyl phosphite with respect to the total mass of the base oil and the thickener is 0.24 mass % to 0.36 mass %.

2. The grease composition according to claim 1, wherein
the base oil is an alkyl diphenyl ether,
the thickener is an alicyclic diurea, and
a proportion of the thickener with respect to the total mass of the base oil and the thickener is 10 mass % to 14 mass %.

3. A rolling bearing in which the grease composition according to claim 1 is enclosed.

4. A rolling bearing in which the grease composition according to claim 2 is enclosed.

5. The grease composition according to claim 1, wherein a proportion of the thickener with respect to the total mass of the base oil and the thickener is 10 mass % to 12 mass %.

* * * * *